US011370594B2

(12) United States Patent
Sutlive

(10) Patent No.: US 11,370,594 B2
(45) Date of Patent: Jun. 28, 2022

(54) ELASTOMER COATED FOAM COOLER AND CARRYING STRAP SYSTEM

(71) Applicant: Spencer Sutlive, Duluth, GA (US)

(72) Inventor: Spencer Sutlive, Duluth, GA (US)

(73) Assignee: Rugged Road, LLC, Duluth, GA (US)

( * ) Notice: Subject to any disclaimer, the term of this patent is extended or adjusted under 35 U.S.C. 154(b) by 154 days.

(21) Appl. No.: 16/801,269

(22) Filed: Feb. 26, 2020

(65) Prior Publication Data

US 2020/0189828 A1 Jun. 18, 2020

Related U.S. Application Data

(60) Provisional application No. 62/810,704, filed on Feb. 26, 2019.

(51) Int. Cl.
*B65D 81/38* (2006.01)
*B65D 43/02* (2006.01)
*B65D 25/28* (2006.01)

(52) U.S. Cl.
CPC ..... *B65D 81/3823* (2013.01); *B65D 25/2841* (2013.01); *B65D 43/0202* (2013.01); *B65D 81/3816* (2013.01); *B65D 2543/00194* (2013.01); *B65D 2543/00314* (2013.01)

(58) Field of Classification Search
CPC ..... B65D 75/38; B65D 11/06; B65D 9/26; B65D 9/04; B65D 9/02; B65D 7/22; B65D 7/045; B65D 7/04; B65D 5/566; B65D 3/22; B65D 81/18; B65D 2585/6812; B65D 81/3823; B65D 43/0202; B65D 81/3816;
(Continued)

(56) References Cited

U.S. PATENT DOCUMENTS 1,788,150 A * 1/1931 Curtin ..... B62B 5/0083 280/35
2,132,316 A * 10/1938 Newton ..... B62B 5/0083 280/35

(Continued)

OTHER PUBLICATIONS https://web.archive.org/.web/20170609025728/http://www.pelican.com/us/en/products/coolers; Title: Coolers; 1 screenshot page submitted; publication date: Jun. 9, 2017; Publisher:Pelican Products, Inc., 23215 Early Avenue, Torrance, CA 90505.†

(Continued)

*Primary Examiner* — Kareen K Thomas
(74) *Attorney, Agent, or Firm* — Conway Eader LLLP; Granison Eader

(57) ABSTRACT

The invention consists of a cooler system entailing a foamed polymer body coated in a layer of elastomer and secured with a strap system. The body of the cooler consists of a base which serves as a container for beverages or other products as well as a lid, designed to fit the base such that it can only be removed by lifting upward. The foamed polymer provides insulation and structure while the elastomer coating and the straps provide increased durability and functionality. The body of the cooler contains grooves in which the straps are housed in order to secure the lid. The strap system also provides a means for carrying the invention as an anchoring place for handles. The resulting cooler system is lightweight and durable as well as inexpensive to construct.

5 Claims, 2 Drawing Sheets

(58) Field of Classification Search
CPC ..... B65D 25/2841; B65D 2543/00314; B65D 2543/00194
See application file for complete search history.

(56) References Cited

U.S. PATENT DOCUMENTS 2,375,338 A * 5/1945 Alexander ..... B62B 5/0083 280/47.131
2,670,969 A * 3/1954 Costikyan ..... B62B 5/0083 410/51
3,539,194 A * 11/1970 Stiles ..... B62B 5/0083 280/47.131
4,846,493 A * 7/1989 Mason ..... A45C 5/146 280/641
5,169,164 A * 12/1992 Bradford ..... B62B 1/20 190/18 A
D358,921 S * 5/1995 Abbema ..... D34/24
5,637,389 A * 6/1997 Colvin ..... A43B 7/34 428/308.4
6,030,673 A * 2/2000 Andersen ..... B29C 55/18 428/36.4
8,123,236 B1 * 2/2012 Helenihi ..... B62B 5/0083 280/35
8,317,046 B2 * 11/2012 Vanderberg ..... F25D 3/06 220/6
8,844,991 B2 † 9/2014 Myers
2009/0200347 A1 † 8/2009 Edralin
2015/0090728 A1 † 4/2015 Lubart
2015/0375918 A1 † 12/2015 Holderness
2016/0311600 A1 † 10/2016 Albert

OTHER PUBLICATIONS

Line-X Coated Cooler on Web Page; https://linex.com/beyond-the-bedliner; 19 pages submitted; Author: Line-X, LLC, 301 James Record Rd, Ste 250, Huntsville, AL 35824; publication date unknown but website states that ("After decades of research, LINE-X has created a comprehensive coatings portfolio that includes polyurethanes, polyureas, aliphati, and hybrid coatings") with specific reference to coolers.; Publisher and place of publication: Line-X, LLC, 301 James Record Rd, Ste 250, Huntsville, AL 35824.†
1993 Davis Core Sales Brochure; Title: KOL-BOY; 5 paged submitted; Author: Davis Core and Pad, 1140 Davis Road, Cave Spring, GA 30124; Publication Date 1993; Publisher: Davis Core and Pad, 1140 Davis Road, Cave Spring, GA 30124.†
Thomas Zizzo, The many uses of polyurea coatings, Wayback Machine capture of May 16, 2014, 14 pages, https://web.archive.org/web/20140516225538/https://www.drive2.ru/users/tjzizzo/.†
Line X, Wayback Machine capture of Jun. 26, 2016, 12 pages, https://web.archive.org/web/20160626200636/https://linex.com/protective-coatings.†

* cited by examiner
† cited by third party

ELASTOMER COATED FOAM COOLER AND CARRYING STRAP SYSTEM

CROSS-REFERENCE TO OTHER APPLICATIONS

This application claims the benefit of U.S. provisional patent application no. 62/810,704 filed on Feb. 26, 2019.

BACKGROUND OF THE INVENTION

Coolers are used to keep goods cold in the absence of electric power. Coolers insulate their contents in a variety of ways. These contents are often accompanied by a quantity of ice or another cold substance in order to create and maintain a cold environment. Disposable coolers are typically lightweight, but are lacking in terms of durability and can be difficult to handle before or after they break. The disposable foam plastics and other polymers used to make these coolers do not offer a good way to anchor carrying handles capable of supporting a significant amount of weight. Permanent, reusable coolers are often made using expensive methods and materials, and as a result can be very heavy and unwieldy. Existing models are often made of dense rigid plastic which increases the overall weight of the cooler, making it difficult to carry. While handles made of cloth, plastic, or rope can be more securely attached to rigid plastics, size and mass pose an obstacle to transporting coolers of this variety. For a long time the market has felt a need for a durable, reusable cooler made from lightweight materials and that is easy to carry.

BRIEF SUMMARY OF THE INVENTION

The invention consists of a cooler made from polystyrene, or a similar lightweight foamed polymer that can be molded easily, and subsequently is coated in polyurea or a similar elastomer and affixed with a carrying strap that makes the cooler easy to move. Foamed hydrocarbon polymers provide an inexpensive base as well as effective thermal insulation for the contents of the cooler. The addition of a coat of elastomer resin prevents the polystyrene from crumbling or breaking as it does in other similar applications. The elastomer can be applied via a spray or a film such as to coat the interior. The combination of these two elements gives rise to a rigid cooler that is both lightweight and durable, but still lacks a suitable anchoring point for a handle.

The invention incorporates a carrying strap that fits into pre molded grooves found on the outside surface of the cooler in order to allow it to be carried easily. These straps work in conjunction with the elastomer coated polymer cooler as less durable, disposable styrene coolers tend to break when they are squeezed. In contrast, a foamed polymer coated in an elastomer or resin is more rigid and is prevented from easily breaking. Without the increased durability, the strap system will not work effectively. Without the strap system, the cooler is difficult to hold and is likely to come open easily. The straps distribute weight evenly across the surface of the cooler to prevent force and stress focusing on a single location or anchoring point, helping to ease durability concerns regarding the means of carrying the cooler. Once affixed, the straps are connected to a handle over top the lid of the cooler to facilitate carrying as well as handles on the sides to allow the cooler to be carried by two individuals.

The straps fit into grooves on the side of the cooler such that, when tightened or latched, the strap system sits inside of the grooves and does not slip out of them. This also serves to secure the cooler's lid during transport. When loosened or unlatched, the straps may be removed entirely and stowed or otherwise affixed to the body of the cooler for storage until the cooler needs to be moved again. The material of which the straps are constructed may vary, but ideally they are made from a material that is strong and waterproof or water resistant. The method of fixing or storing the straps may likewise vary so long as they perform their main purpose, which is to secure the lid and the provide a secure anchoring point for handles to be used while transporting the cooler between locations.

DETAILED DESCRIPTION

Figure 1:
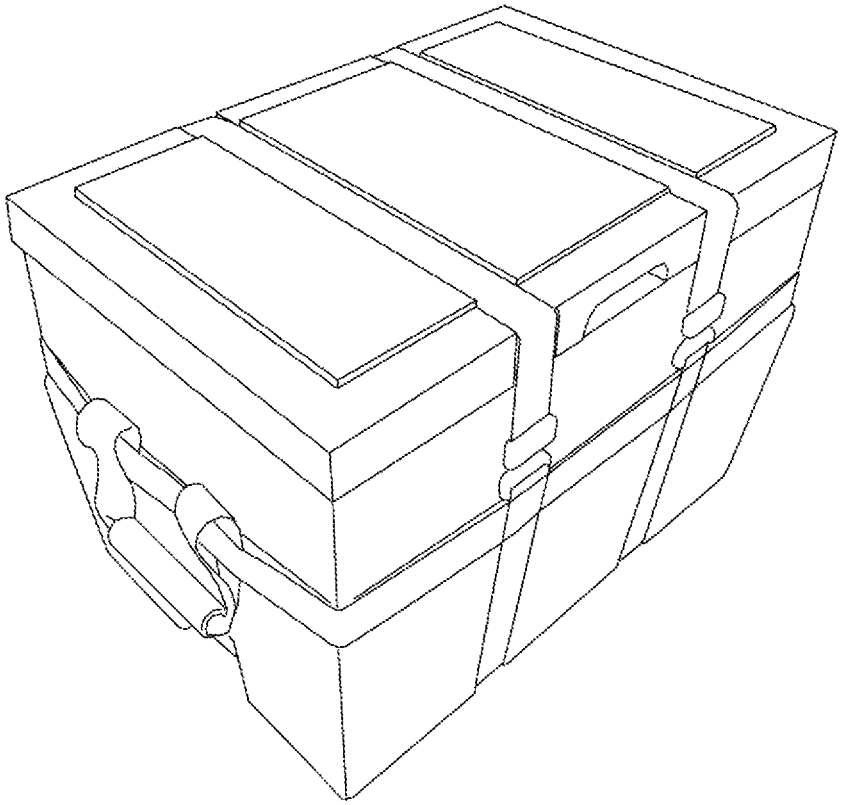
FIG. 1 shows the construction of the invention from above and at an angle. The body is composed of foamed polystyrene polymers subsequently coated in a polyurea elastomer coating. The straps are shown, in this configuration with two wrapping over the lid and a perpendicular strap wrapping around the body of the cooler. The sides, lid, and base of the cooler are molded with grooves to facilitate the straps. The straps that cross over the lid of the cooler are attached to the perpendicular strap around the body of the cooler. The straps are of such a length that, when fastened together they are held within the grooves on the cooler and the lid, preventing them from sliding off of the cooler. Handles are attached to the perpendicular strap to allow the cooler to be carried easily.
Figure 2:
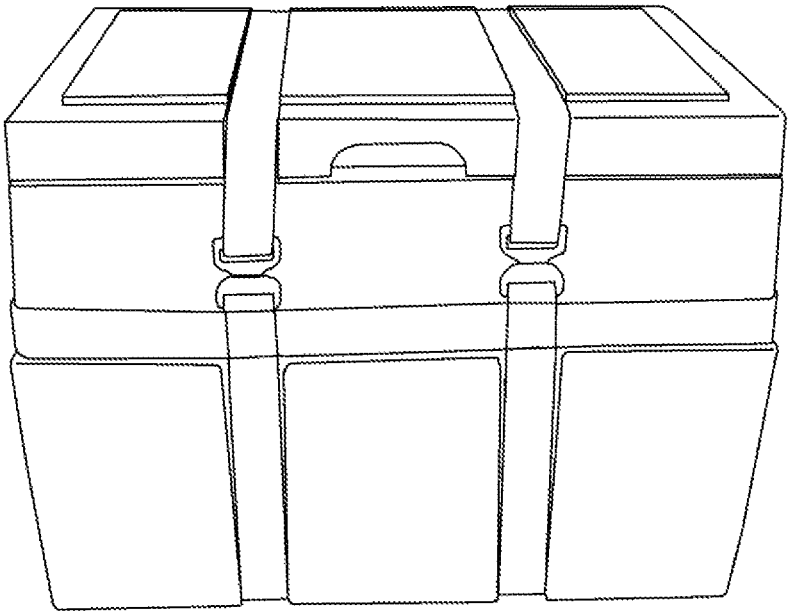
FIG. 2. shows the invention directly from the front. The grooves on the body and lid of the cooler are fully visible and the straps can be seen fastened within them. The clasps are above the horizontal strap on either vertical strap, which fastens the lid but allows for it to be removed if the straps are unclasped. The horizontal strap is fixed to either vertical strap where the two pass over one another. The lid has a lip that fits within the body of the cooler and prevents it from moving side to side, requiring the lid to be pulled upward to remove it from the body without breaking the body of the cooler or the lid.

The following description will include references to specific structural embodiments and methods. It is to be understood that there is no intention to limit the invention to the specifically disclosed embodiments and methods, but the invention may be practiced using other features, elements, methods and embodiments. Preferred embodiments are described to illustrate the present invention, not to limit its scope. A number of different equivalents exist for many of the materials used in the invention. Specific embodiments are given to provide examples, however embodiments which incorporate materials with properties similar to those noted in the materials chosen should also be considered. Those of ordinary skill in the art will recognize a variety of equivalent variations on the description that follows.

The base of the cooler is made from a foamed polymer sprayed into a mold. In one embodiment, this polymer is polystyrene. Foamed polymers are inexpensive to manufacture and provide a workable degree of insulation. The polystyrene provides the underlying structure of the cooler, so the mold used to create the polystyrene body is determinate of the shape of the cooler. The mold used in this invention gives the body and lid of the cooler deep grooves which will later be used to house the straps. At least one side of the lid includes a lip designed to fit inside the body and prevent the lid from sliding off without being lifted up. The lid of the cooler may be molded in such a fashion that it includes cup holders, logos, or other branding as well. In one embodiment of the invention, the lid of the cooler may be reversible and the underside may likewise be molded to contain an alternative set of cup holders, logos, or other branding. Polystyrene and other foamed polymers employ pockets of air which provide buoyancy in addition to insulation.

The body of the cooler is coated in an elastic polymer or "elastomer" in order to increase its durability. In one embodiment of the invention the elastomer used is polyurea. A coat of polyurea is applied to both the inner and outer surfaces of the body and the lid. Elastomers are applied while liquid in an even layer around the foam body. This application can be accomplished by aerosol or similar spray devices or as a liquid bath in which the body and lid of the cooler are submerged. Other embodiments include other elastic polymers with high strain failure such as but not limited to natural polyisoprene rubber, synthetic polyisoprene, polybutadiene, chloroprene rubber, ethylene, propylene, silicone rubber, fluoroelastomers, or vinyl can be used interchangeably. Any rubber-like solid with elastic properties that can coat the styrene base and stretch in response to macroscopic stresses is a potential substitute. Most elastomers are also water proof or water resistant.

The combined elastic polymer coated foam polymer body is surrounded in straps that hold it together and provide a means for carrying the cooler. At least one horizontal strap is tightened within the groove around the middle of the container. In one embodiment, this horizontal strap is the anchoring point for a handle on either end of the cooler. At least one vertical strap in used to secure the lid of the cooler. All straps include a means for lengthening or shortening such that the can be adjusted to fit snuggly to the body of the cooler. The straps fit within the grooves on the body and lid of the cooler such that, when fastened or tightened, the straps are held entirely within the grooves. Handles are attached to the strap system, avoiding the damage created by anchoring a handle within the body. The straps disperse the weight of the cooler along the sides of the body and allow for the strap to withstand a far greater amount of weight than would be able with any anchor into foamed polystyrene or an equivalent medium. As a result, the cooler may be easily carried without fear of damage, even when full.

The present embodiment of the cooler bears numerous advantages. Its construction, while lightweight and durable, is achieved using inexpensive materials. The result is an inexpensive cooler that is durable, flexible, buoyant, lightweight, waterproof, and easily transported. This new design combines the positive aspects of disposable coolers with the permanence of their more durable rigid plastic counterparts. As a result, the invention not only bears economic value but has the potential to lower the environmental impact of the cooler industry as a whole by limiting the creation of waste in the low cost cooler market.

The invention claimed is:

1. A recreational cooler system, comprising:

a foamed and molded polymer body having at least a sidewall and a bottom wall defining a cavity;

a foamed and molded polymer lid that serves as a top wall when placed atop the foamed and molded polymer body;

a polyurea coating affixed to an exterior surface of the foamed and molded polymer body and the foamed and molded polymer lid; and a set of straps encircling both the foamed and molded polymer body and the foamed and molded polymer lid.

2. The cooler of claim 1, where the foamed and molded polymer body and the foamed and molded polymer lid are both molded with a set of grooves for the purpose of accommodating the set of straps encircling the cooler.

3. The cooler of claim 2, where the set of straps can be tightened into the set of grooves in the foamed and molded polymer body and the foamed and molded polymer lid where they rest securely until loosened.

4. An insulated storage container, comprising:

a foam polymer body having at least one sidewall and at least one bottom wall defining a storage space;

a separate foam polymer lid that serves as a top wall of the foam polymer body;

an elastic coating affixed to an entire surface of the foam polymer body;

an elastic coating affixed to the entire surface of the foam polymer lid; and a means for securing the elastic coated foam polymer lid to the elastic coated foam polymer body for transport;

where the foam polymer body and the foam polymer lid are molded to incorporate a set of grooves designed to house a harness such that said harness secures the foam polymer body to the foam polymer lid when the harness is placed over the grooves and tightened into place.

5. A portable cooler system comprised of:

a body and a lid constructed of separate pieces of lightweight foamed polymers molded to provide structure and insulation for a storage cavity;

an elastic coating applied to an entire exterior of the body and the lid in order to encase each separate piece; and a means of securing the two coated separate pieces to one another in order to secure and transport the insulated storage cavity where the means of securing the two coated pieces to one another consists of adjustable external straps, and where an exterior structure of the pieces includes depressions which accommodate the adjustable external straps.

* * * * *